United States Patent [19]

Pfalzgraf et al.

[11] Patent Number: 5,036,813

[45] Date of Patent: Aug. 6, 1991

[54] LOAD-SHIFTING DEVICE

[75] Inventors: Manfred Pfalzgraf, Frankfurt Am Main; Gerd Hickmann, Schwalbach/Ts.; Eberhard Mausner, Liederbach/Ts., all of Fed. Rep. of Germany

[73] Assignee: VDO Adolf Schindling AG, Frankfurt am Main, Fed. Rep. of Germany

[21] Appl. No.: 455,607

[22] Filed: Dec. 22, 1989

[30] Foreign Application Priority Data

Jan. 20, 1989 [DE] Fed. Rep. of Germany ..... 3901585

[51] Int. Cl.[5] ..... F02D 45/00; F02D 41/02; F02D 41/16

[52] U.S. Cl. ..... 123/339; 123/361

[58] Field of Search ..... 123/337, 339, 340, 361, 123/399

[56] References Cited

U.S. PATENT DOCUMENTS

| | | | |
|---|---|---|---|
| 4,756,287 | 7/1988 | Sakakibara et al. | 123/361 X |
| 4,841,931 | 6/1989 | Ohm et al. | 123/399 X |
| 4,848,297 | 7/1989 | Hickmann et al. | 123/399 X |
| 4,896,640 | 1/1990 | Pfalzgraf et al. | 123/361 X |

FOREIGN PATENT DOCUMENTS

| | | |
|---|---|---|
| 262883 | 4/1988 | European Pat. Off. . |
| 3711779 | 10/1988 | Fed. Rep. of Germany . |

*Primary Examiner*—Tony M. Argenbright
*Attorney, Agent, or Firm*—Martin A. Farber

[57] ABSTRACT

A load-shifting device has a control element (8*a*, 8*b*) which acts on a setting member 9 which determines the output of an internal combustion engine. A control element cooperates with a driver (4) which is coupled to an accelerator (1). The driver is controllable in addition by means of an electrical setting drive 14 which cooperates with an electronic controller (17). In the load-shifting device, a setting path of the driver in idling direction is limited by an idling stop (LL). Upon application of the driver against the idling stop, the control element is movable in its idling control range relative to the driver by means of the electric setting drive. With a simple structural development the load-shifting device makes it possible to control the internal combustion engine over its entire load range and, in particular, by means of the electrical setting drive, over its idling range.

21 Claims, 3 Drawing Sheets

LOAD-SHIFTING DEVICE

FIELD AND BACKGROUND OF THE INVENTION

The present invention relates to a load-shifting device having a control element which acts on a setting member, wherein the setting member determines the power output of an internal combustion engine, and the control element cooperates with a driver. The driver is coupled with an accelerator and, in addition, can be controlled by an electric setting drive which cooperates with an electronic controller.

Load-shifting devices, for instance load-shifting devices cooperating with carburetors or injection pumps, must satisfy the need for optimum control of the internal combustion engine over its entire load range. This requires a complicated construction or a complicated control of the load-shifting device. Thus, carburetors, for example, have, in addition to the actual device for the forming of the mixture, additional devices such as thinning, starting, idling, accelerating, economizing devices, etc. These devices complicate the construction of the carburetor and result in increased expense for parts since, for example, additional injection nozzles, pumps, special developments of nozzle needles and separate air feeds are required, entirely aside from extracting control requirements inherent in this.

Of particular importance in the case of load-shifting devices is the control of the load condition under idling. During idling, only minimal power is given off by the internal combustion engines, however, there may be present, especially in the case of automobiles, load consuming devices which require a high power output, such as fans, rear-window heating, air conditioners, etc. In order to take these potential demands on the power into account, control of the load-shifting device between a maximum and a minimum idling setting is required. Also upon failure of the control, an idle emergency setting of the setting member or of the control element must be assured.

Differing from the problem described above, load-shifting devices of the aforementioned type are, as a general rule, used in cases where the accelerator and the setting member are electronically connected to each other. The accelerator is coupled to the driving device and the latter is connected to the control element. Furthermore, a desired-value detection element associated with the driver and an actual-value detection element cooperating with the desired-value detection element and acting on the electric setting drive are provided. The electric setting drive is controllable by the electronic controller as a function of the values detected.

The electrical connection of accelerator and setting member with the interposed electronic controller makes it possible, by means of the accelerator and the driver coupled thereto, to compare predetermined desired-value positions with the actual-values indicated by the position of the control element and the setting member. These elements can also be checked for the presence or absence of plausibility conditions. Thereby, upon the presence or absence of given plausibility conditions, there is the possibility of exerting a correcting action, via the electronic controller, by controlling the electric setting drive, on the setting member. The setting member may formed as a throttle valve or injection pump. Thus, action by the electronic controller for the avoidance of wheel slippage of an automotive vehicle, upon starting due to an excessive power output called for by the accelerator, can be provided. Other automatic interventions into the load-shifting device are to be considered in the case of automatic shifting processes of a transmission or a speed-limiting control.

SUMMARY OF THE INVENTION

It is an object of the present invention to create a load-shifting device of the aforementioned type which, while of simple construction, permits control of the internal combustion engine over its entire load range and, in particular, of its idling range.

According to the invention, the setting path of the driver (4) in idling direction is limited by an idle stop (LL). The control element (8*a*, 8*b*) is movable, upon application of the driver (4) against the idle stop (LL), in the idling control range of the control element relative to the driver (4) by means of the electric setting drive (14).

Due to the inventive development of the load-shifting device, control over the entire idling control range takes place exclusively by means of a single setting member, so that no additional devices for the forming of the mixture in the idling control range are required. The control element which moves the setting member is movable in the idling control range by means of the electric setting drive independently of the driver. This occurs while the control element is coupled to the driver outside the idling control range and the driver can move the control element and thus the setting member.

In accordance with a specific embodiment of the invention, there is provided a projection (11) which is disposed on the driver (4) and engages behind the control element (8*a*, 8*b*). With a minimal idling position ($LL_{min}$) of the control element, the projection comes against this stop together with the latter. A spring (12) is arranged between the driver (4) and the control element (8*a*, 8*b*) to urge the control element (8*a*, 8*b*) in idling direction. This urging takes place over the entire idling control range.

According to a feature of the invention, the spring (12, 12*a*) urges the control element (8*a*, 8*b*) over the entire idling control range. When the driver is applied against the idle stop, the idling control range of the control element is thereby limited, on the one hand, by the projection on the driver and, on the other hand, by the position in which the spring is completely compressed, it being possible to limit the latter position also by a further projection on the driver.

The moving of the control element by means of the electric setting drive thus takes place in the direction towards a maximum idling position against the force of the spring. In the direction of a minimum idling position, the movement of the control element takes place aided by the spring. The urging of the control element in idling direction can be effected independently of the spring by a further spring (12*a*) arranged directly between the control element (8*a*, 8*b*) and a stationary point (29).

In order to assure a definite idling position of the control element, and thus of the setting member, upon failure of the electronic controller or of the electric setting drive, it is proposed that the control element (8*a*, 8*b*) be urged in full-load direction into an idling emergency position ($LL_{NOT}$), by means of an additional spring (20) of limited path or acting in the direction of a stop on the side of the full load, in which case the spring force of this additional spring (20) must be large enough that it can overcome not only the force of the spring urging in the idling direction but, in addition, also a further force possibly acting directly on the setting member. When the setting member is developed as throttle valve which is mounted off-center for reasons of safety, this force can be produced, for instance, by the vacuum forces in the intake manifold acting on the throttle valve in the closing direction. Depending on the predetermined limitation of path of the spring, the idling emergency position can be selected within the entire idling range, but a relatively high idling position is preferred in order to assure power consumption by large loads also upon a failure of the electronic controller.

The electric setting drive (14) can advisedly be coupled to the control element (8*a*, 8*b*) via a coupling (13). Movements of the control element introduced into the latter via the driver can thus take place without it being necessary for the electric setting drive also to be moved.

One embodiment of the invention of particular interest provides that the control element (8*a*, 8*b*) be made of two parts, namely a first control-element part (8*a*) which cooperates with the driver (4) and acts on the setting member (9), and a second control-element part (8*b*) which can be controlled by the electric setting drive (14). The first control-element part (8*a*) extends into the setting path of the second control-element part (8*b*) on the side thereof facing the maximum idling position ($LL_{MAX}$). By arranging the second control-element part behind the first control-element part in the full-load direction, assurance is had that all control processes steps of the load-shifting device in the partial-load and full-load ranges can take place independently of the second control-element part.

The activation of the electric setting drive takes place only when the driver is applied against the idle stop. The electric setting drive, upon a movement in the direction of the maximum idling position, moves the first control element in the direction of this position against the force of the spring which is associated with the driver, while the opposite movement is supported by the spring.

When the control element is developed in two parts, the additional spring which assures the idling emergency position, upon failure of the electronic controller or of the electric setting drive, is to cooperate with the second control-element part. In addition to this, a stop (16) for the limiting of the setting range, which stop is associated with the maximum idling position ($LL_{MAX}$) of the control element (8*a*, 8*b*), can also cooperate with the second control-element part (8*b*).

Further, according to the invention, the spring (12*a*) connected to the stationary point (29) and cooperates with the first control-element part (8*a*).

Still further according to the invention, the additional spring (20) cooperates with the second control-element part (8*b*).

The electronic controller controls the electric setting drive for regulating the control element and the setting member in the control range. The electronic controller is to be fed with variables related to the plausibility conditions as well as with idling data on the internal combustion engine. Therefore, an actual-value detection device (18) is provided which cooperates directly with the electronic controller (17). The actual-value detection device can, in this connection, be associated either with the first control-element part (8*a*) or with the second control-element part (8*b*), and it is furthermore conceivable to associate actual-value detection devices with both control-element parts.

The different associations primarily serve the purpose of monitoring the idling control range or, in addition, the partial-load/full-load range.

Furthermore, a contact (19) for determining the idling position of the driver (4) is to be provided as well as a safety contact (27) for the electric setting drive (14). The safety contact (27) detects the idling control range of the control element (8*a*, 8*b*). The setting drive is coupled with the second control-element part (8*b*) and switches upon maximum idling position. By means of these elements which detect the positions of driver and control element and which cooperate with the electronic controller (17) it is possible to build up a safety logic for the load-shifting device.

As described above, the development of the control element in two parts assures a control of the setting member which is independent of the driver in the idling range. The control is provided by the second control-element part which is acted upon by the electric setting drive controlled by the electronic controller.

In addition to this, the first control-element part extends into the setting path of the second control-element part on the side of the latter facing the maximum idling position. The interconnection of the two control elementk parts assures, upon movement of the second control-element part beyond the maximum idling position, that action on the first control-element part is in the sense of a speed-limitation control. The speed-limitation control operates in the manner that the first control-element part is applied against the second control-element part and controls the latter in the partial-load/-full-load range independently of a pulse introduced via the accelerator.

With such a speed limitation control, a connection of the electronic controller with the switch contact is to be assured, so that upon leaving the idling control range and thus a change in the contacting via the electronic controller, the electric setting drive acting on the second control-element part nevertheless remains activated.

The connection of the electronic controller with the switch contact is associated with the second control-element part for detection of the idling control range of the control-element part.

If the speed limitation control is deactivated in the partial-load and/or full-load range, then a deactivation, for example, of the coupling arranged between the electric setting drive and the setting member, takes place. As a result, upon movement of the driver, and consequently of the first control-element part, the latter can reset the second control-element part in the idling direction, or else there is a rapid return movement in idling direction brought about by the control electronics and effected by the electric setting drive.

In accordance with a further embodiment of the invention, it is proposed that the driver (4), the setting member (9), the control element (8*a*, 8*b*), i.e. the first control-element part and the second control-element part, as well as the electric setting drive (14) form a structural unit (28).

According to another feature of the invention, the control element (8*a*, 8*b*) can be moved by means of the electric setting drive (14) in the entire idling range of the internal combustion engine.

Also, the control element (8a, 8b) can be moved by means of the electric setting drive (14) in the entire load range of the internal combustion engine.

BRIEF DESCRIPTION OF THE DRAWINGS

With the above and other objects and advantages in view, the present invention will become more clearly understood in connection with the detailed description of preferred embodiments, when considered with the accompanying drawing, of which.

DETAILED DESCRIPTION OF THE PREFERRED EMBODIMENT

Figure 1:
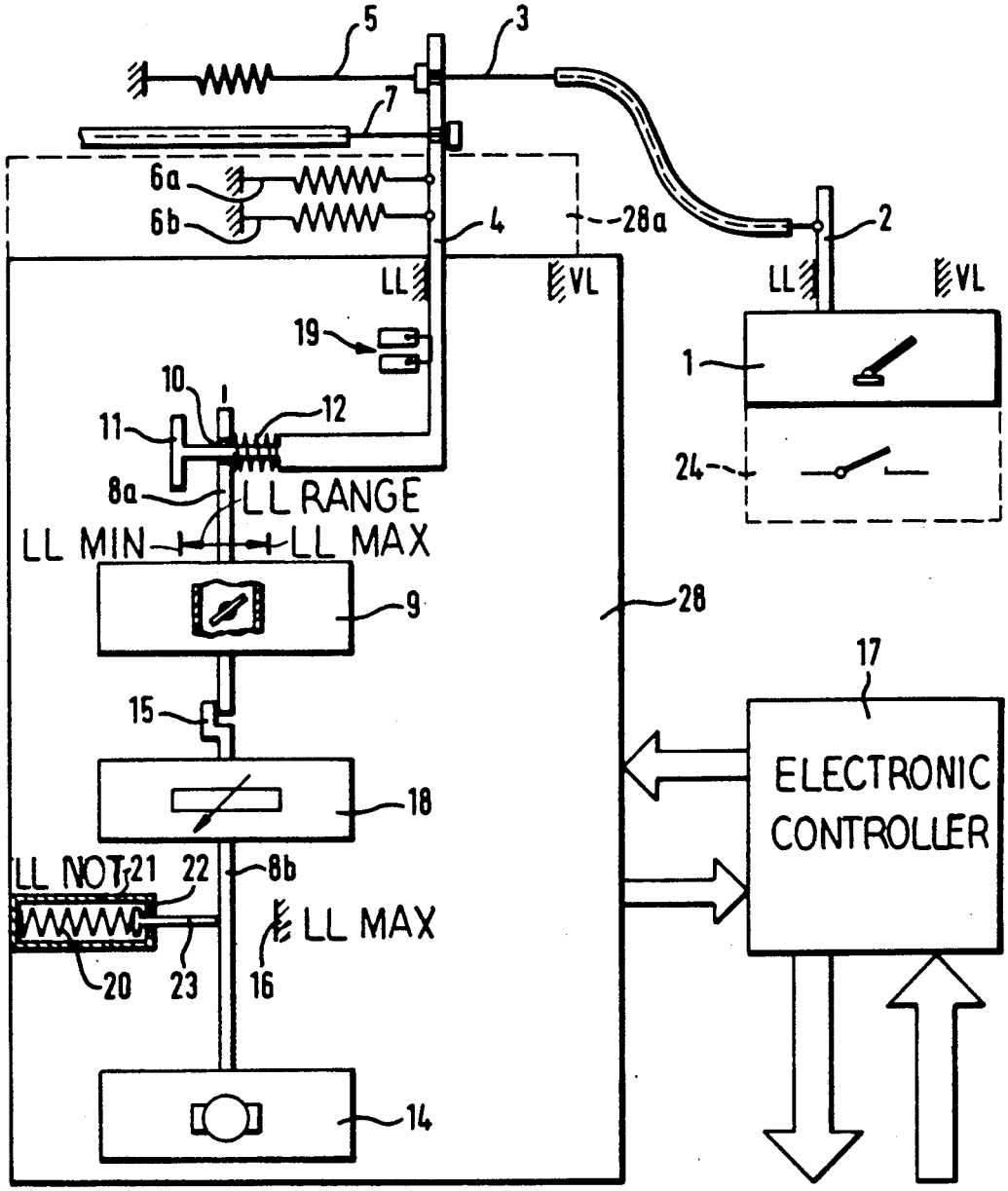
FIG. 1 is a block diagram of a first embodiment of the load-shifting device according to the invention, operating as idling control, shown in the emergency operating position.

FIG. 1 shows an accelerator 1 by means of which a lever 2 can be displaced between an idling stop LL and a full-load stop VL. By a gas cable 3, the lever 2 can displace a driver 4, which is movable between a further idling stop LL and a further full-load stop VL in the direction of the full-load stop VL associated with the driver. The lever 2 is urged in the idling direction by a restoring spring 5 which acts on the gas cable 3. Two restoring springs 6a and 6b act on the driver 4 to urge the driver in idling direction. The two springs 6a and 6b are so designed that they have redundant effects on the restoring drive, and each one of them is able to supply the force required to move the driver 4 into its LL-position, even against the opposing forces inherent in the system and acting on the driver. When the gas cable 3 is not acted on, the driver 4 rests against its idling stop LL. The driver 4 can also displace an automatic cable 7 of an automatic transmission, not shown in detail.

The driver 4 cooperates directly with a first control-element part 8a which serves to displace a setting member 9 developed as throttle valve of the internal combustion engine. In detail, the end of the first control-element part 8a facing the driver 4 is provided with a recess 10 behind which a projection 11 of the driver 4 engages. Furthermore, a spring 12 is arranged on the side of the first control-element part 8a which faces away from the projection 11 of the driver 4 and is located between the driver 4 and the first control-element part 8a. The spring urges the first control-element part 8a in idling direction. With a minimum idling position of the first control-element part 8a, the latter is applied against the projection 11 of the driver 4. The spring 12 in this case urges the first control-element part 8a over its entire idling control range. Upon a movement of the driver 4 beyond the idling control range by operation of the accelerator 1, i.e. in partial-load/full-load operation, the first control-element part 8a rests, under the action of the spring 12, against the projection 11 of the driver 4, so that the first control-element part 8a acting on the setting member 9 is displaced corresponding to the movement of the driver 4.

The load-shifting device in accordance with the invention has, in addition to the first control-element part 8a, a second control-element part 8a which is connected to an electric motor setting drive 14. In order to be able to couple the two control-element parts 8a and 8b mechanically to each other, the second control-element part 8b has a projection 15, the first control-element part 8a extending, on the side of the projection 15 facing the maximum idling position, into the setting path thereof and thus into the setting path of the second control-element part 8b. A movement of the second control-element part 8b in the $LL_{MAX}$ direction—or the full load direction and/or $LL_{MIN}$—thus leads to an application of the projection 15 against the first control-element part 8a. The first control-element part 8a is then displaced by means of the electric motor setting drive 14 against the force of the spring 12 in the direction of the maximum idling position, or agaisnt the force of spring 20 via a ram 23 into the $LL_{MIN}$-position.

As can be noted from FIG. 1, the displacement path of the second control-element part 8b, and thus also the displacement path of the first control-element part 8a, is limited in the direction of the maximum idling position by a stop 16 which extends into the path of the second control-element part 8b at the position of the maximum idling $LL_{MAX}$. A limitation of movement the second control-element part 8b in the direction of the minimum idling position is not required, since either the first control-element part 8a rests in this position against the projection 11 of the driver 4 or the second control-element part 8b reaches its limit at a stationary sleeve 21.

The controlling of the load-shifting device of the invention takes place by means of an electronic controller 17. An actual-value detection device 18 for the idling range, which is associated with the second control-element part 8b and determines the instantaneous position of the first control-element part 8a, cooperates with said electronic controller 17. In addition to this, the electronic controller 17 detects signals which are given off by an idling contact 19 which is activated whenever the driver 4 is applied against the idling stop LL associated with it. Furthermore, external state variables concerning the internal combustion engine or, in general, concerning the automobile equipped with it, are fed to the electronic controller 17 and are retrieved from it as well as transferred from the electronic controller to the electric motor setting drive 14 which acts on the second control-element part 8b. The electronic controller 17 thus serves in cooperation with the actual-value detection device 18 and idling contact 19 as well as the external reference values, to build up a safety logic concerning the control of the first and second control element parts 8a and 8b and of the driver 4.

If the lever 2, which cooperates with the accelerator 1, is in its idling position LL and the driver 4 is thus at the idling stop LL, then the contacting of the idling contact 19 takes place and, if plausibility conditions are present, the electric motor setting drive 14 is activated by the electronic controller 17. Thereby the setting member 9 is controlled, as desired by the control electronics 17, in the idling range between a minimum and a maximum idling position. The plausibility conditions are in this case verified inter alia by means of the actual-value detection device 18 which can display the entire idling range of the internal combustion engine.

If the electronic controller 17 or the electric motor setting drive 14 is without voltage, then the spring 20 of limited path, pre-tensioned in the direction of the maximum idling position, accomplishes the displacement of the second control-element part 8b into an idling emergency position $LL_{NOT}$. To achieve this, the force of the spring 20 must be large enough to overcome not only the force of the spring 12 but, in addition to this, also the vacuum forces in the intake manifold which act on the throttle valve 9 in the direction of closing. The vacuum forces develop because the throttle valve is usually mounted off-center so that a vacuum always acts on the throttle valve in the direction of closing. The limitation of the path of the spring 20 can, for instance, take place by the ram 23. The ram 23 is displaceable in the stationary sleeve 21 against a stop 22 and is acted on by the spring 20. Upon a movement of the second control-element part **8*b* by means of the electric motor setting drive 14 in the direction of the minimum idling position, the ram 23 is pushed into the sleeve 21 by the second control-element part 8*b* tension the spring 20** further.

In the event that the driver 4 cannot be displaced in the idling direction after the release of the accelerator 1, a pedal contact switch 24 which can detect such a malfunction is provided on the accelerator 1.

Figure 2:
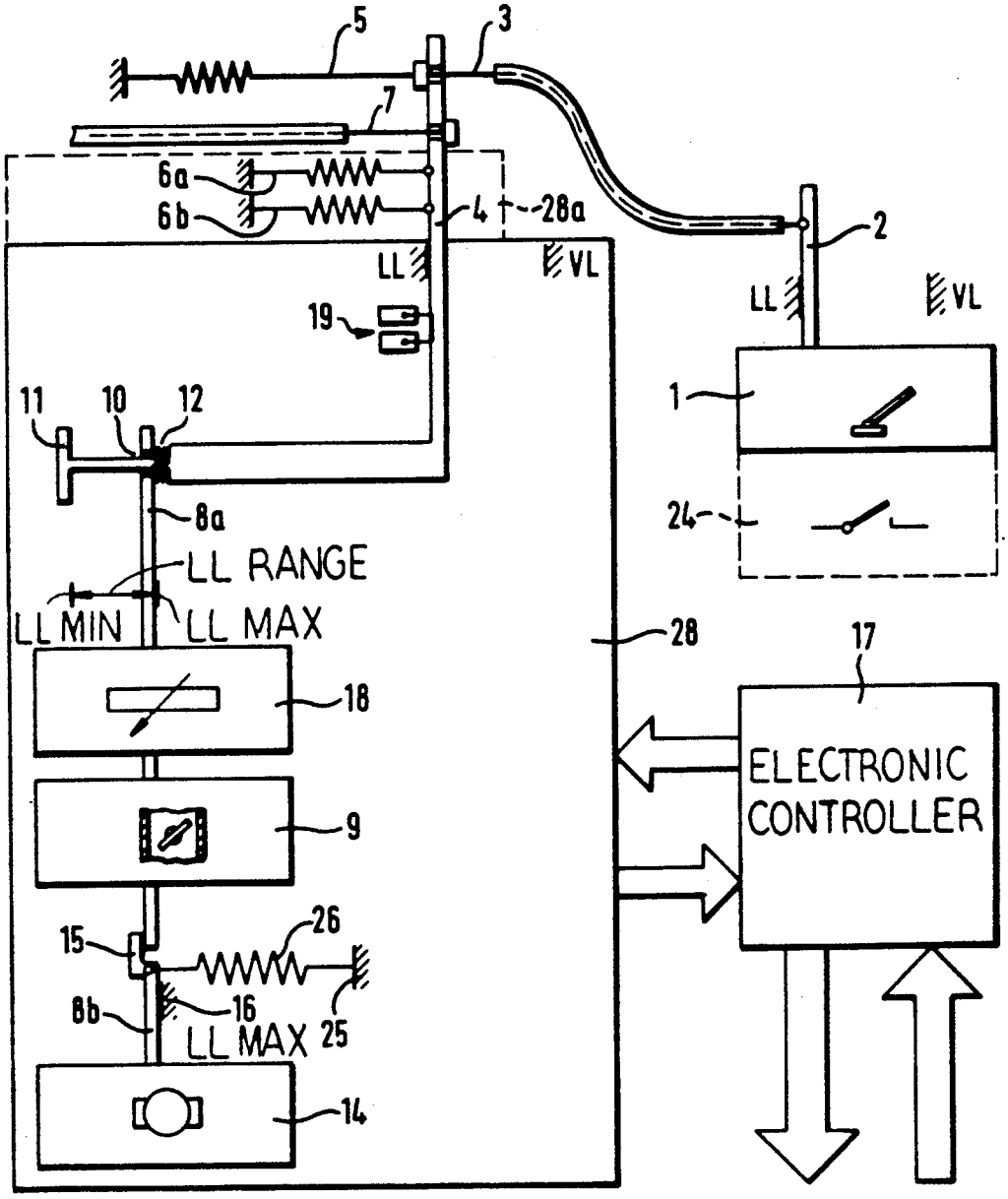
FIG. 2 is a block diagram of a second embodiment of the load-shifting device according to the invention, operating as idling control, shown in the maximum idling position.

FIG. 2 shows an embodiment which is modified with respect to the embodiment of FIG. 1 and is shown in maximum idling position of the first and second control-element parts **8*a*, 8*b*. Parts which are identical in their construction and function to the embodiment of FIG. 1** have been given the same reference numbers for the sake of simplicity.

It can be noted from FIG. 2 that when the second control-element part **8*b* is applied against the stop 16, the second control-element part 8*b* moves the first control-element part 8*a* into the maximum idling position, in which position the spring 12, which faces the driver 4, is completely compressed. In contradistinction to the embodiment of FIG. 1, the embodiment shown in FIG. 2 has associated with the first control-element part 8*a*, only an actual-value detection device 18 by means of which the entire load range, i.e. idling, partial-load and full-load range of the internal combustion engine can thus be displayed; furthermore, the embodiment of FIG. 2 has no spring 20 of limited path to assure the idling emergency position but, rather a tension spring 26 which acts directly on the second control-element part 8*b* and is connected to a stop 25 on the full-load side. Upon failure of the electronic controller 17 or the electric motor setting drive 14, the spring 26, via the second control-element part 8*b*, thus pulls also the first control-element part 8*a* against the force of the spring 12** into the idling emergency position which is identical to the position $LL_{MAX}$.

Figure 3:
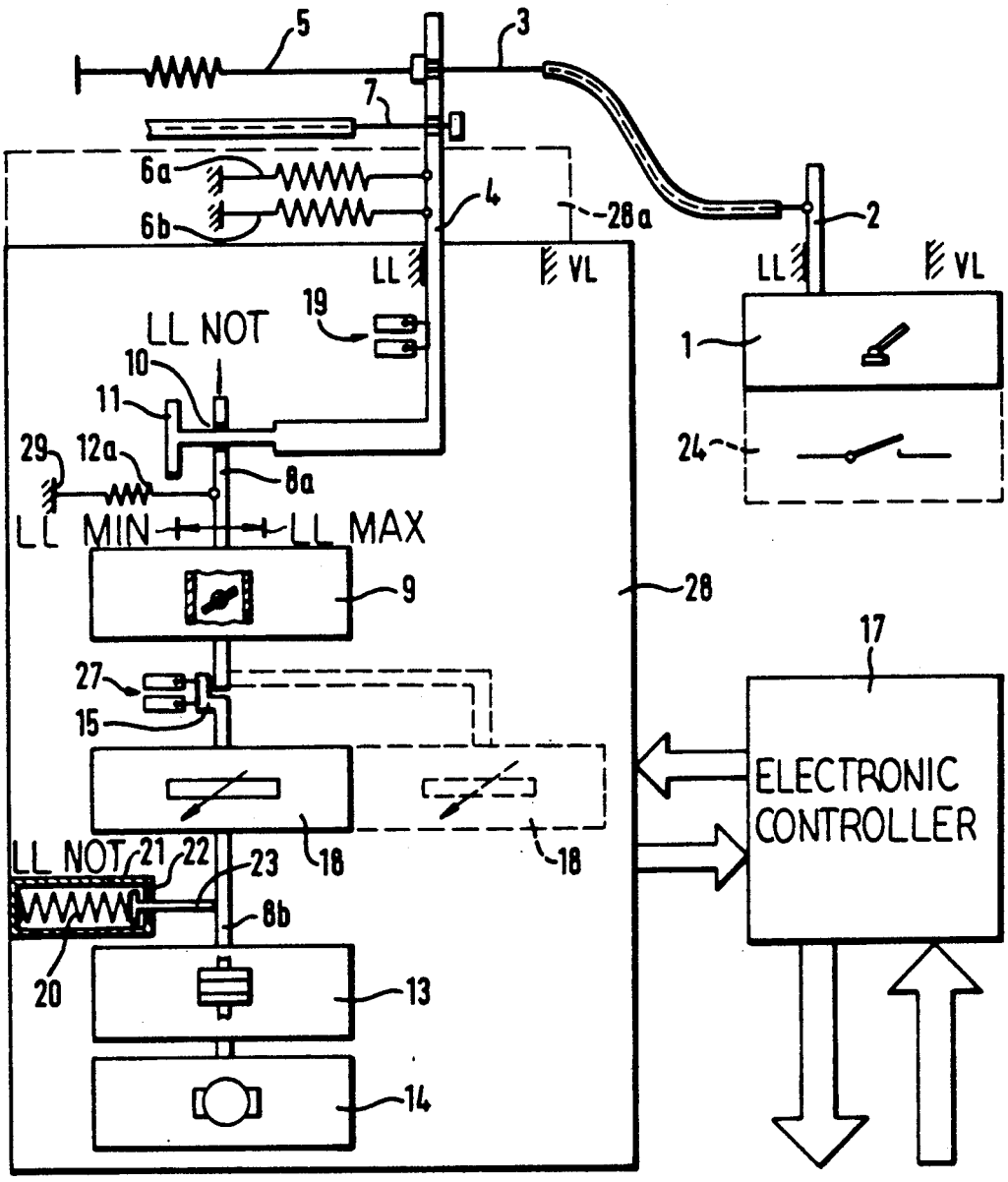
FIG. 3 is a block diagram of a third embodiment of the load-shifting device according to the invention, operating as idling control and speed limitation control, shown in the emergency operating position.

FIG. 3 shows a construction of the load-shifting device of the invention which is based on the embodiment of FIG. 1 and has modifications which permit not only an idling control of the load-shifting device but also a speed limitation control. Parts which agree in their construction and function with the embodiment of FIG. 1 have again been given the same reference numbers for the sake of simplicity.

The embodiment shown in FIG. 3 has, first of all, instead of the spring 12 arranged between the driver 4 and the first control-element part **8*a*, a spring 12*a* arranged directly between the control-element part 8*a* and a fixed point 29, the spring 12*a* acting on the control-element part 8*a* in idling direction. By this fixed arrangement of the spring 12*a*, a direct restoring of the setting member (throttle valve) 9 is obtained, the spring 12*a* being active over the entire adjustment range of the control-element part 8*a* and thus over the entire load range of the internal combustion engine. It is therefore, possible to reduce the force of the springs 6*a* and 6*b*. In addition, the embodiment shown in FIG. 3 does not have a stop 16 limiting the maximum idling position, but rather a contact 27 which covers the entire idling control range of the second control-element part 8*b* and has a switch point at $LL_{MAX}$. Finally, both the first control-element part 8*a* and the second control-element part 8*b* have an actual-value detection device 18** associated with them, the actual-value detection device associated with the first-mentioned control-element part covering the entire load range and thus providing primarily a speed limitation control function. Thereby, the other actual-value detection device serves to monitor the idling control.

The control in the idling range takes place in the embodiment of FIG. 3 corresponding to that in the embodiment shown in FIG. 1. If a speed-limitation control in the partial-load/full-load range of the internal combustion engine is to take place with the load-shifting device shown in FIG. 3 via the electronic controller 17 and the electric motor setting drive 14, then this leads first of all to a movement of the second control-element part **8*b* in the direction of full load and to a corresponding movement of the first control-element part 8*a* up to a position $LL_{MAX}$. Upon further upward control, the contact 27 switches and thus gives off a signal to the electronic controller 17 which recognizes it so as to effect a speed limitation control. The preset speed is converted via the electronic controller 17 into a load variable which the electric motor setting device 14 converts by corresponding displacement movement of the second control-element part 8*b* and thus of the first control-element part 8*a* which cooperates with the setting member 9**.

Upon deactivation of the speed-limitation control, the control-element part **8*b* is moved by the electric motor setting device 14 into the idling range so that the control-element part 8*a*, upon movement of the driver 4 in the idling direction, predetermines the position of the setting member 9 until it comes to rest against the control-element part 8*b* via the projection 15. The coupling 13 shown in FIG. 3 is, for instance, opened in the event of an implausibility between the pedal contact switch 24, the idling contact 19 and/or the contact 27 or the actual-value detection device 18 with control-element part 8*a* and/or control-element part 8*b* respectively, the spring 20 in this case placing the control-element part 8*b*** in the LL emergency position.

The frame 28 shown in the figures indicates that the parts enclosed by it form a structural unit. The driver 4, the two control-element parts **8*a* and 8*b*, the setting member 9 and the electric motor setting drive 14 are essential features of the structural unit. The additional frame 28*a* shown in dashed line indicates that the restoring drive of the driver 4, which is represented by the springs 6*a*, 6*b***, can also be part of the structural unit.

We claim:

1. A load-shifting device comprising;

a setting member which establishes the power output of an internal combustion engine, and a control element which acts on the setting member;

a driver, an accelerator for applying fuel to the engine, an electric setting drive, an idle stop, and an electronic controller; and wherein the control element cooperates with the driver, and the driver is coupled with the accelerator and is controlled by the electric setting drive operating in conjunction with the electronic controller;

a setting path of said driver in an idling direction is limited by said idle stop (LL); and said control element, in its idle control range, is movable relative to said driver upon application of said driver against said idle stop by said electric setting drive.

2. A load-shifting device according to claim 1, further comprising a projection disposed on said driver and an idle spring; and wherein said projection engages behind said control element and, in a minimal idling position ($LL_{min}$) of the control element, comes against said stop together with the control element, and said spring is arranged between said driver and said control element for urging the control element in idling direction.

3. A load-shifting device according to claim 1, further comprising a stationary fixed point, a projection disposed on said driver, and an idle spring; and wherein said projection engages behind said control element and, in a minimal idling position ($LL_{min}$) of the control element, comes against said stop together with the control element, and said spring is arranged between said control element and the stationary point for urging the control element in idling direction.

4. A load-shifting device according to claim 2, wherein said spring urges the control element over the entire idling control range.

5. A load-shifting device according to claim 2, further comprising;

an additional spring, a setting member operatively coupled to said control element, and a full-load stop; and wherein said additional spring operates over a limited length of path; and said control element is urged in full-load direction into an idling emergency position by means of said additional spring for acting in the direction of said full-load stop, in which case the spring force of said additional spring is at least as large as a total force of said idle spring and an additional force on said setting member, the additional spring being arranged between said driver and said control element for urging the control element in idling direction.

6. A load-shifting device according to claim 3, further comprising;

an additional spring, a setting member operatively coupled to said control element, and a full-load stop; and wherein said additional spring operates over a limited length of path; and said control element is urged in full-load direction into an idling emergency position by means of said additional spring for actin in the direction of said full-load stop, in which case the spring force of said additional spring is at least as large as a total force of said idle spring and an additional force on said setting member, the additional spring being arranged between said driver and said control element for urging the control element in idling direction.

7. A load-shifting device according to claim 2, further comprising;

an additional spring, a setting member operatively coupled to said control element, and a full-load stop; and wherein said additional spring operates over a limited length of path; and said control element is urged in full-load direction into an idling emergency position by means of said additional spring for acting in the direction of said full-load stop, in which case the spring force of said additional spring is at least as large as a total force of said idle spring and an additional force on said setting member, the additional spring being arranged between said control element and the stationary point for urging the control element in idling direction.

8. A load-shifting device according to claim 3, further comprising;

an additional spring, a setting member operatively coupled to said control element, and a full-load stop; and wherein said additional spring operates over a limited length of path; and said control element is urged in full-load direction into an idling emergency position by means of said additional spring for acting in the direction of said full-load stop, in which case the spring force of said additional spring is at least as large as a total force of said idle spring and an additional force on said setting member, the additional spring being arranged between said control element and the stationary point for urging the control element in idling direction.

9. A load-shifting device according to claim 1, further comprising a coupling; and wherein said electric setting drive is coupled to said control element via said coupling.

10. A load-shifting device according to claim 1, further comprising a setting member operatively coupled to said control element; and wherein said control element comprises a first control-element part which cooperates with said driver and acts on said setting member, and a second control-element part which is controllable by said electric drive, said first control-element part extending into a setting path of said second control-element part on a side thereof facing the maximum idling position.

11. A load-shifting device according to claim 10, further comprising a maximum-idle stop for limiting the setting range, which stop sets the maximum idling position of the control element and limits movement of the second control-element part.

12. A load-shifting device according to claim 10, further comprising, an idle spring connected to a stationary point of said load-shifting device for acting on said first control-element part.

13. A load-shifting device according to claim 5, wherein said additional spring acts on second control-element part.

14. A load-shifting device according to claim 1, further comprising, a first contact for determining the idling position of the driver and a safety contact for said electric setting drive.

15. A load-shifting device according to claim 14, wherein, the safety contact is a control element, which contact cooperates with the electronic controller.

16. A load-shifting device according to claim 10, further comprising, an actual-value detection device which is coordinated with the control element and operates with the electronic controller.

17. A load-shifting device according to claim 16, further comprising, said actual-value detection device is coordinated either with ~~at~~ least one of the first control-element part and the second control-element part.

18. A load-shifting device according to claim 1, further comprising, a setting member operatively coupled to said control element; and wherein the driver, the control element, the setting member and the electrical setting drive form a unitary assembly.

19. A load-shifting device according to claim 10, wherein, said driver, said setting member, said first control-element part and said second control-element part, and said electric setting drive together form a unitary assembly.

20. A load-shifting device according to claim 1, wherein said control element is movable by said electric setting drive in the entire idling range of the internal combustion engine.

21. A load-shifting device according to claim 1, wherein said control element is movable by said electric setting drive in the entire load range of the internal combustion engine.

* * * * *